United States Patent [19]

Peyrat et al.

[11] Patent Number: 4,753,602

[45] Date of Patent: Jun. 28, 1988

[54] CONNECTOR, METHOD FOR INSERTION OF A MALE CONTACT INTO A FEMALE CONTACT, AND DEVICE FOR CARRYING OUT SAID METHOD

[75] Inventors: Daniel Peyrat, Arnage; Jackie Thenaisie, Le Mans, both of France

[73] Assignee: Societe Souriau Cie (S.A.), France

[21] Appl. No.: 85,232

[22] PCT Filed: Apr. 10, 1985

[86] PCT No.: PCT/FR85/00079

§ 371 Date: Nov. 6, 1985

§ 102(e) Date: Nov. 6, 1985

[87] PCT Pub. No.: WO85/04770

PCT Pub. Date: Oct. 24, 1985

Related U.S. Application Data

[63] Continuation of Ser. No. 800,641, Nov. 6, 1985, abandoned.

[30] Foreign Application Priority Data

Apr. 10, 1984 [FR] France ..... 84 05642

[51] Int. Cl.[4] ..... H01R 13/64

[52] U.S. Cl. ..... 439/78; 439/246; 439/651

[58] Field of Search ..... 439/78–84, 439/246–252, 655, 682–684, 692, 693, 733, 751, 869, 651

[56] References Cited

U.S. PATENT DOCUMENTS

| | | | |
|---|---|---|---|
| 2,991,440 | 7/1961 | Kulka | 339/220 R |
| 3,086,074 | 4/1963 | Just et al. | 339/221 M |
| 3,440,597 | 4/1969 | Baker II et al. | 339/221 R |
| 3,462,726 | 8/1969 | Stark et al. | 339/64 R |
| 3,602,875 | 8/1971 | Pierini | 339/221 M |
| 4,035,047 | 7/1977 | Ammon | 339/221 M |
| 4,327,954 | 5/1982 | Aldridge et al. | 339/64 M |

FOREIGN PATENT DOCUMENTS

| | | | |
|---|---|---|---|
| 781607 | 8/1957 | United Kingdom | 339/220 R |

*Primary Examiner*—Gil Weidenfeld
*Assistant Examiner*—Gary F. Paumen
*Attorney, Agent, or Firm*—Sughrue, Mion, Zinn, Macpeak, and Seas

[57] ABSTRACT

A connector assembly is effected between a board with a plurality hole of holes of given internal diameter and a connection body having an insulating piece with bores therein equal in number to the holes of the board and generally aligned therewith. Pins equal to the number of holes and bores have opposite ends projecting respectively beyond parallel faces of the insulating piece. Each of the pins has from its end proximate to the board, a first longitudinal section of a diameter smaller than the internal diameter of the holes in the board, a second longitudinal section of a diameter larger than the internal diameter and a tapered part joining the first and second sections, at least one guiding part located in a corresponding bore of the insulating piece and the pin terminating in a male connection member. The insulating piece bore for each pin has a lower, smaller diameter section adjacent to its side facing the board, at most equal to the diameter of the guiding part, and an upper section of a diameter larger than the diameter of the guiding part. As a result, each pin is fitted in the board with a slight interference fit when the third, longitudinally tapered part abuts the board with the guiding part moved within the insulating piece bore from the smaller diameter section of the bore and being located entirely in the larger diameter of the bore to provide the pin with lateral play relative to the insulating piece while the pin is self-centered by the tapered part interference fitted in the hole of the board.

2 Claims, 5 Drawing Sheets

CONNECTOR, METHOD FOR INSERTION OF A MALE CONTACT INTO A FEMALE CONTACT, AND DEVICE FOR CARRYING OUT SAID METHOD

This is a continuation of application Ser. No. 800,641 file Nov. 6, 1985 now abandoned.

FIELD OF THE INVENTION

The present invention relates to connectors, the methods for insertion of a male contact into a female contact and the devices for carrying out said methods which are applicable to the transmission of multiple electrical data, in particular, but not solely, for telephone exchanges.

BACKGROUND OF THE INVENTION

In the field of telecommunications in the broad meaning of the term, that is, when it is a matter of transmitting electrical data from a station "A" to a station "B", which are distant from one another, it is necessary to use connectors so as to connect the various elements to one another. Therefore, the connection must be as reliable as possible. In effect, a bad connection, at the level of the contact, vis-a-vis its respective housing, automatically causes the non-operation of one of the elements constituting the electrical data transmitter assembly. For this purpose, it is necessary to call on a technician to firstly locate the breakdown and secondly carry out the so-called repair. Therefore equipment which is as reliable as possible from the point of view of its conception, manufacture and control, is absolutely necessary.

In this field of data transmissions by means of connectors, quality is a major concern which manufacturers of this type of equipment must scrupulously respect, in particular in the case of multiple electrical connections, that is those using several tens of contacts arranged in as small a surface as possible, on the order of a few $cm^2$, in which the contacts must cooperate with a complementary connector or, more specifically in accordance with the object of the invention, with a printed circuit board in which are provided complementary orifices capable of receiving the contacts of a connector.

In a more specific manner, the connectors presently used for this type of connection comprise contacts or pins which mount in housings provided in an insulating body which thus acts as a support. The number of said contacts placed in said body is determined depending upon use and the standards in force and is therefore very variable.

During the manufacture of this assembly composed of the insulating body and the contacts, said contacts are positioned in the body so as to prevent any degree of possible freedom for them and they are therefore integral with said body. Thus when, using an appropriate machine or even manually, this assembly is assembled with the orifices or holes provided in a printed circuit board, the result is particularly that, when the number of contacts is large, for example between 50 and 100, one or several of said contacts does not completely correspond sizewise to the respective orifice provided in the board due principally to the problem of manufacturing tolerances connected to the respective assembly of the contacts, the insulator and the orifices in the board. Therefore, for example, the end of the contact deteriorates the conductor layer deposited on the printed circuit before penetrating into the orifice, thus causing a power failure at the level of the circuit.

In addition, contacts which are difficult to engage in their orifices are subjected to mechanical stresses of the buckling and flaming type which could cause their partial or total deformation.

Thus, this type of connector assembly, which those in the art call a global insertion connector due to the fact that the contacts are integral with the insulating body in which they are arranged, has some disadvantages which, in spite of the present quality of manufacture, can cause incidents of the type mentioned above.

The object of the present invention is to overcome these various disadvantages by proposing for this purpose a method for insertion of a male contact into a female contact and thus avoiding possible deterioration of the printed circuit board, power cuts of the conductor layer deposited on the board and providing good mechanical holding of the contacts.

SUMMARY OF THE INVENTION

More specifically, the object of the present invention is a method for insertion of a male contact into a female contact and means for carrying out said method, said female contact comprising an orifice with a given cross-section, the male contact being composed of at least a first part having a cross-section which is slightly greater than the cross-section of a second part with a cross-section being less than the orifice cross-section, said second part at the end of said male contact being connected to the first part by a comical third part from said method being characterized by the fact that it consists:

in a first phase, of bringing said second part more or less opposite said orifice of the female contact whilst exerting lateral holding of said male contact, in a second phase, of bringing, by longitudinal translation, said second part into said female orifice until the third part comes into contact with the edge of said orifice, in a third phase, of releasing the lateral holding of said male contact, and, in a fourth phase, of simultaneously exerting axial pressure in order to introduce the second part into the orifice of the female part.

In accordance with another characteristic of the invention, the method is characterized by the fact that the lateral holding of said male contact is carried out in a body comprising a hollow housing having passages of at least two different interior cross-sections, said male contact having a fourth part whose exterior cross-section is substantially equal to the smallest of the two interior cross-sections of said housing; said fourth part being held in said smallest section during the first and second phases and being released in this small section by sliding of said body in relation to said contact in order that said fourth part comes opposite the larger of the two cross-sections.

BRIEF DESCRIPTION OF THE DRAWINGS

Other characteristics and advantages of the present invention will become apparent from the following description, given in reference to the drawings attached by way of illustration, but which are in no way limitative, in which.

DESCRIPTION OF THE PREFERRED EMBODIMENTS

The present invention resides in a method which, regardless of the relative initial positions of the male and female contacts, provides perfect introduction of these two contacts into one another.

Figure 1:
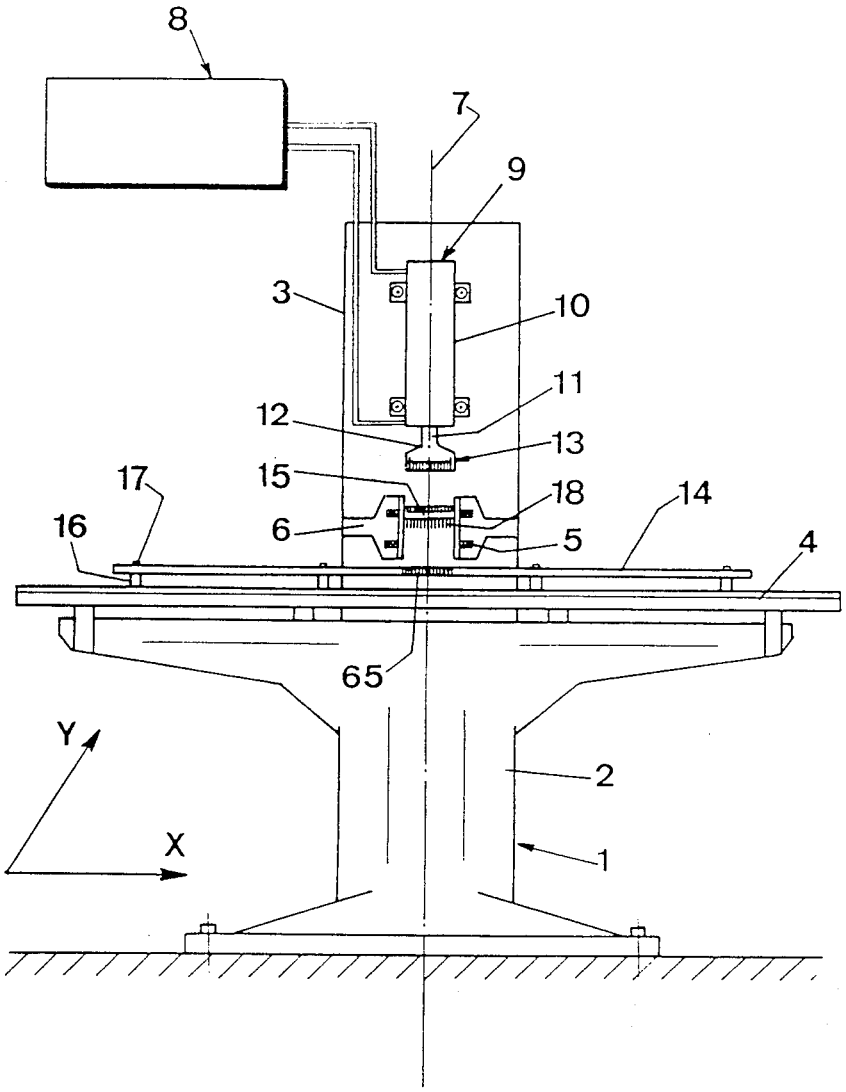
FIG. 1 partially and schematically represents a device enabling the carrying out of the method in accordance with the invention, the steps of which are shown in FIGS. 2A, 2B, 2C and 2D.

Of course, this same method can be applied simultaneously to several couples of female and male contacts and specific advantageous means for lateral holding of these contacts can be produced so as to obtain industrial working of the method. FIGS. 1 and 2 A to D show an example of advantageous industrial working in accordance with the characteristics of the method of the present invention.

Reverting to FIG. 1, this represents a device for working the insertion method in accordance with the invention which in a schematic and concise manner comprises a machine 1 composed of a housing 2 on which a column 3 is mounted. The housing 2 carried a table 4 which is able to move in accordance with two coordinates at X and Y thus defining a plane. The means for movement of said table 4, in relation to its housing 2, are not illustrated but provide no difficulty of understanding since they are well known to those skilled in the art.

On column 3 are fixed, on the one hand, a support plate 6 which contains holding means 5 and, on the other hand, a device such as a jack 9 supplied with a fluid (hydraulic, pneumatic) composed of a cylinder 10 and a stem 11, the end 12 of which is fitted to receive a cover 13. Of course, the support plate 6 and the jack 9 are arranged in accordance with a same vertical axis 7. On table 4 of housing 2 a board is arranged which is composed of a printed circuit, said board being fixed by given positioning and holding means, for example, by fingers 16 or any other means providing the same result.

Bores 17 are provided on this printed circuit board 14 which are able to cooperate with the fingers 16.

In this manner the board 14 only rests on these fingers 16 and therefore the interior surface opposite the table 4 of the board 14 is not in contact therewith and thus will not be damaged. On this printed circuit board 14 are already provided the orifices 65 constituting the female contacts, which will receive the male contacts of a connector, as well as the various electrically conductive layers connecting the various circuits of said board.

Reverting to the support plate 6, connected to column 3, said plate contains holding means 5 which are schematically shown by springs acting under pressure against a support plate receiving the connector so as to maintain it. This connector is defined by an insulating body 15 in which are provided a plurality of housings or bores 19 which, by way of example, number ninety-six distributed in three rows of thirty-two housings.

Thus, in these housings 19 are maintained the male contacts or pins 18 whose adjustment and positioning in the insulating body 15 will be more fully described with regard to FIGS. 3A to 3D which represent on a larger scale a male contact in its housing.

Reverting to jack 9, the end 12 of the stem 11 of the jack is provided with a cover 13 which, more precisely, corresponds to the complement of the assembly formed by the body 15 and its contacts 18. This cover 13 therefore contains as many cells as contacts 18, that is, in the present case, ninety-six. These cells are, for example, produced in a light alloy element which, during its operation, will take the form of the interior of the body 15 from which the upper ends of contacts 18 emerge. The structure and particularly the operation of said cover, which will act as a press, will be more fully explained with regard to the various FIGS. 2A to 2D which show the operation of said method. Before introducing said method, it is obvious that all adjustments of table 4, at the level of these coordinates at X and Y, and of the jack 9, at the level of its path, will already be carried out by an operator. Consequently, the above-defined ninety-six contacts of the insulating body 15 will be more or less in the axis of ninety-six orifices in the printed circuit board 14. In addition, the control means providing the various sequences of operation of the components being moved will be given by means of a control block 8.

Turning more specifically to the description of FIGS. 2A to 2D, these show the various steps of the method applied to a single contact, but it is very obvious that the operation is the same for a connector assembly fitted with a plurality of contacts, in the present case 96 contacts.

Figure 2A:
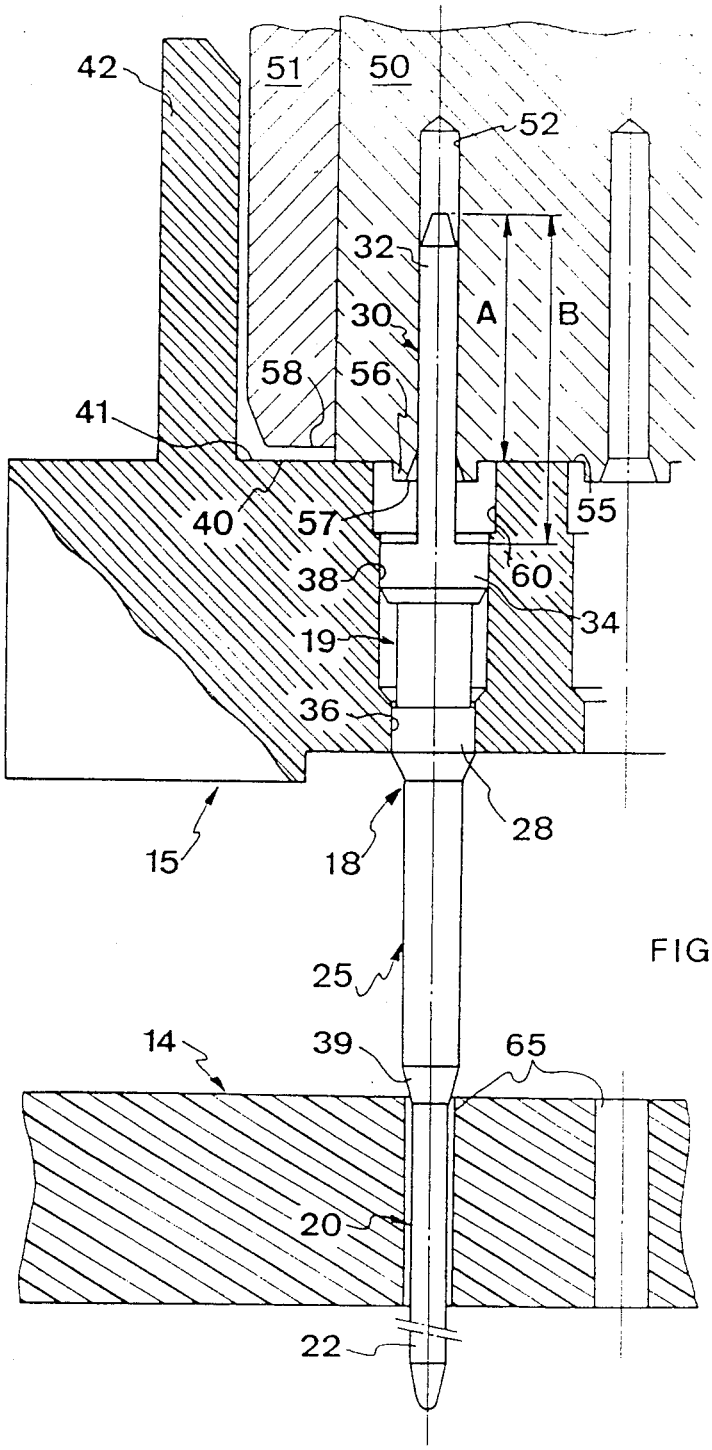

FIG. 2A shows the contact 18 mounted in the housing 19 of body 15. In a more detailed manner, this contact 18 is composed of a first zone 20 corresponding to an end 22 of said contact 18, which is called a joining zone, defining a first cross-section with a considerably smaller cross-section than the cross-section of orifice 65 of board 14, a second zone 25 situated between the first zone 20 and a shoulder 28, which is called a connection zone inserted by force, defining a second cross-section, and a third zone 30 situated from the shoulder 28 to the second end 32 of the contact, which is called the male activity zone, which is capable of cooperating with a female component which is not shown in the drawings. In addition, this third zone contains a second shoulder 34.

Thus, when contact 18 is introduced into housing 19 of body 15, during a preceding assembly phase, the shoulders 28 and 34, which have different cross-sections, completely take the form of two passages 36 and 38 which define housing 19. The cross-sections of shoulder 28 and passage 36 are more or less identical, as are the cross-sections of shoulder 34 and passage 38.

In this manner, the adjustment produced between the contact and the housing of the body is sufficiently tight that there is no play in the contact. This adjustment is sufficiently effective that this contact takes on no lateral play during any operation whatever, but on the other hand, this contact-housing connection enables, by means of an adapted tool on said machine press, such as the above-described cover, said contact to slide in its housing.

In addition, in the structure of contact 18, it is to be noted that the connection between the two zones 20 and 25, that is, the first and second zones, is carried out by means of a chamfer 39, which, in the insertion method of the contact into the orifice 65 of the printed circuit board, will have two clearly defined functions, that is, a first function as a stop and a second function of centering.

Prior to mounting the assembly of the insulating body 15 provided with its contacts 18 in the support plate 6 of machine 1, these contacts 18 are engaged in body 15 during a first operation carried out on a specific machine and this introduction of contacts 18 into the housings 19 is determined such that the distance 1 defined between the end 32 of the contact 18 and the exterior surface 40 of the bottom 41 of body 15 is less than the distance B defined between the same end 32 and shoulder 34 of the contact. This height B corresponds more or less to the standard in force for the use of this type of connector. Thus, when this assembly exits said machine, the ends 32 of contact 18 all emerge with a same height A in relation to the bottom 41 of block 15.

At that time the connector can be brought and positioned in the machine as defined schematically in FIG. 1 and in particular in the support plate 6 by being held, by means of plate pressure means pushed by the springs around body 15 of the assembly. Obviously, these holding means can be of a different conception, their object being to provide sufficient guiding and holding of the body.

In this manner, after having checked that the positioning of the various contacts in relation to the orifices provided in the printed board is more or less carried out, the operator can then activate the control means arranged in the control block 8 and start the process of insertion in accordance with the invention.

With regard to FIGS. 2 and 3A, stem 11 of jack 9, under the effect of fluid pressure, moves along a vertical direction defined by axis 7, and its end 12 which supports cover 13 then begins to cover the assembly formed by the body 15 and the contacts 18.

Structurally the cover 13 is composed of two components 50 and 51 which are able to move in relation to one another and/or with each other depending upon the various control sequences. The press component 50 is composed of a number of blind bores or cells 52 which are equal to the number of contacts 18 (in this case 96) and exit onto a main surface 55 which is able to press against the internal surface 40 of the base 41 of insulating body 15. The ends of each cell opposite the main surface 55 contain a boss 56 which is able, by its surface 57, to come opposite the shoulder 34 of each contact. Thus, the interior diameter of the cells is slightly greater than the diameter of end 32 of the contacts 18 so as not to damage said contacts during the introduction of the cells.

The press component 51 envelopes the first component 50 and is of a more or less complementary shape to the internal volume defined by the base 41 and the lateral edges 42 of the body 15. This component moves to come into contact with the internal surface 40, defined above, by means of its main surface 58.

In this manner, the first component 50 arrives opposite end 32 of the contact 18 and as this component descends, the cells cover ends 32 of the various contacts until the main surface 55 of component 50 comes into contact with the internal surface 40 of the body 15. In this position, almost all of end 32 of the contact, or more specifically the third zone 30, is in part covered by this component 50, whilst component 51 stops at a certain distance from the internal surface 40. It should be noted that the introduction of the contacts in the cells 52 of component 50 is carried out with no problem, since a chamfer is provided in boss 56 which provides better guiding during the introduction of the ends of these contacts. Thus, as defined above, the first component 50 is in contact with the insulating body 50 by means of its main surface 55 and therefore, since the pressure is still applied in the stem of jack 9, said component 50 continues its descent taking insulating body 15 with it. The force, or more precisely, the pressure exerted by the main surface 55 against the internal surface 40 is sufficient to overcome the friction due to the adjustment of the contact or contacts 18 in their housing 19, in particular at the level of their two shoulders 34 and 28 which cooperate with the passages 38 and 36 of housing 19. Thus, as the body descends by means of element 50, the shoulders 34 and 28 of the contact are no longer maintained in their respective passages and consequently a certain play between the lateral surface of shoulder 28 and passage 38 is created, as is between the lateral surface of shoulder 34 with a third passage 60 which has a larger cross-section than passage 38. However, well before this phenomenon occurs at the level of the shoulders, end 22 of contact 18 and, more specifically, the first zone 20 defining the connection zone is introduced at the level of orifice 65 provided in the printed circuit board 14.

Thus, while descending body 15 and progressively releasing the shoulders maintained in the respective adjustment, end 22 itself is engaged in orifice 65 of board 14.

Figure 2B:
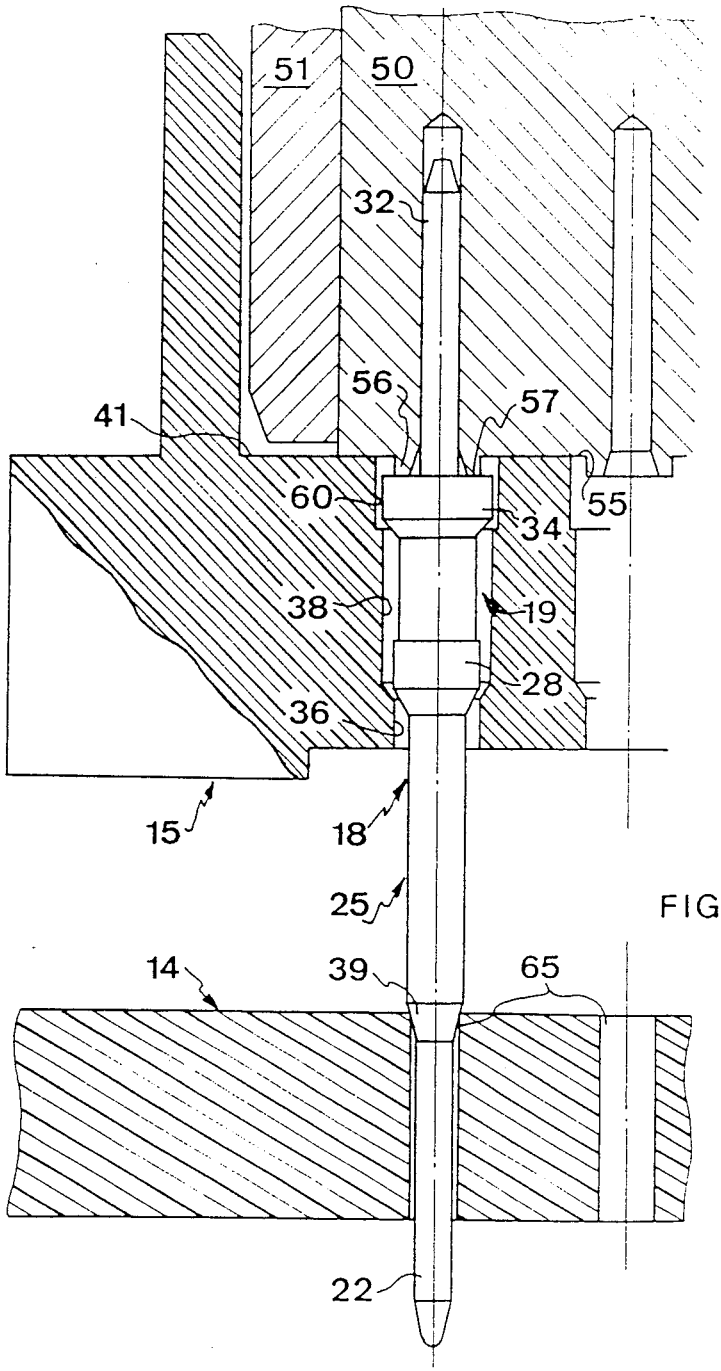

FIG. 2B shows just this presentation at the point of the above-described sequence where it can be seen that the two shoulders 28 and 34 of contact 18 are no longer maintained in their respective passages 36 and 38 and are opposite passage 38 for shoulder 28 and passage 60 for shoulder 34 due to the fact of their difference in cross-section. In addition, the first connection zone 20 is completely inside orifice 65 of board 14 up to the level of the above-described chamfer 39 which acts as a stop. Thus, in this position, the contacts 18 are free in the lateral direction which therefore comprises a certain play, and are taken between the printed circuit board, which holds end 22 of contact 18, and cell 52 which holds the other end 32 of the contact. Thus contact 18 no longer takes the form of housing 19 of the insulating body 15. In addition, in this phase of the operation, surface 57 of boss 56 of component 40 has almost reached the contact of shoulder 34.

Figure 2C:
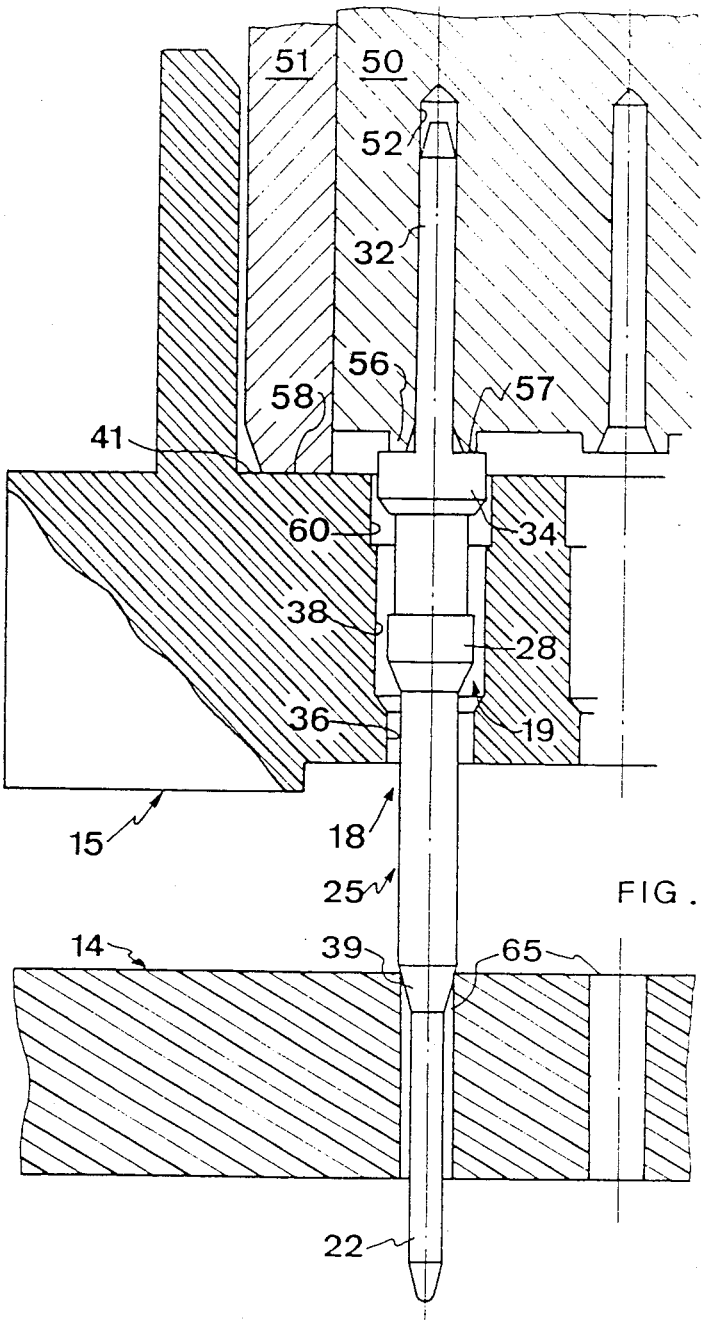

FIG. 2C shows more precisely the joining of contact 18 which is carried out by means of the surface of boss 56 against shoulder 34. In this drawing the second press component 51 continues its descent taking with it, by means of its main surface 58, the insulating body 15 as is shown in FIG. 2C, which also shows that contact 18 is sandwiched between the boss 56 of component 50 and the orifice 65 of board 14.

Figure 2D:
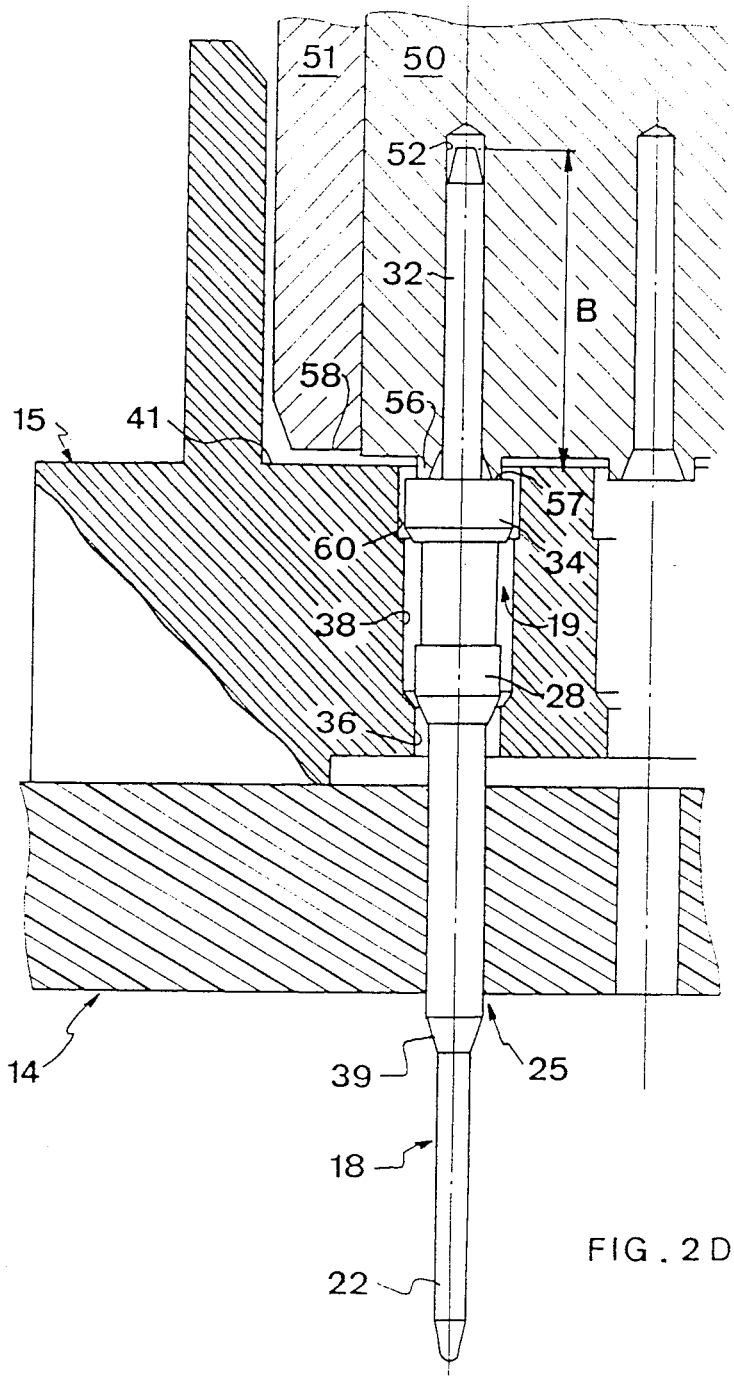

FIG. 2D represents the phase after the actual insertion of the contact in orifice 65 of the board up to its completion.

Thus, the pressure exerted on component 50 by the fluid from jack 9 is sufficient to overcome the counter-reaction forces which are located at the level of orifice 65 against chamfer 39. The insertion of this second zone 25 of contact 18 is carried our progressively by modifying the cross-section of said second zone which is deformed so as thus to provide sufficiently solid adhesion with the corresponding orifice 65 to avoid subsequent disconnection. This method of insertion by force in fact replaces the solderings formerly carried out for this type of art. It should be noted that due to the fact that the contact is no longer in its housing in body 15, since it is no longer opposite the respective shoulders, said contact is therefore entered, with a certain mobility due to its play and, consequently end 22 centers itself in the orifice 65 without damaging in any way the metallization of the orifices. At the end of insertion, body 15 is in abutment on the board, but obviously does not rest on the active parts of said board, whilst the descent of the first component 50 stops once the above-described dimension B, which corresponds to the standard in force, is achieved. In this final representation, FIG. 2D, it can also be noted that contact 18 is still floating at the level of its housing 19, but is no longer in contact with the passages which cooperated with its shoulders. Thus, during the joining of another connector, which is opposite ends 32 of the contact, said ends can also orientate themselves by a certain value, so as to engage in the orifices which will correspond to ends 32.

Once these various sequences are completed, the next operation consists of remounting the stem of the jack with its cover and to move table 4 of the machine by a certain amount in order to again start the process of electrical connection with another connector opposite corresponding orifices of the board.

Therefore, this method enables a very accurate connection to be obtained by avoiding all the disadvantages previously mentioned, which disadvantages come from the type of connector used in which the contacts are integrally mounted with the insulating body. It is very obvious that such a method would work just as well for the use of a connector containing less contacts, even with only one contact. This method is advantageous, particularly for a connector with several contacts where the problem of centering and introduction between the axes defined by the contacts and the axes defined by the orifices is resolved.

Obviously, the description of the machine enabling the use of such method has only been given very schematically and it is obvious that a change in one or several components providing the same result would fall within the scope of the invention.

What is claimed is:

1. In a connector assembly comprising a board provided with a plurality of holes of given internal diameter and an overlying connection body having an insulating piece parallel to and spaced some distance above said board and relatively movable towards said board in a direction perpendicular to said board, said insulating piece having opposite parallel faces and the same number of pins to the number of said holes, each of said pins projecting beyond each parallel face of said insulating piece, the improvement wherein:

each of said pins has from its end proximate to the board:

(i) a first longitudinal section of a diameter smaller than said internal diameter of said holes, (ii) a second longitudinal section of a diameter larger than said internal diameter, (iii) a third longitudinally tapered part between said first and second sections, (iv) at least one guiding part located in a bore of said insulating piece, and (v) a terminal projection constituting a male connection member for a corresponding removable female one, and;

(vi) said insulating piece having for each pin, a said bore having a lower, smaller diameter section at its side facing said board, of a diameter at most equal to the diameter of said guiding part, and an upper section of a diameter larger than the diameter of said guiding part, wherein said pin is fitted in a said board hole and makes a slight interference fit with said lower, smaller diameter section of said bore, wherein, movement of said connection body and said insulating piece towards said board effects, when said third tapered part abuts said board, movement of said lower, smaller diameter section of said bore relative to said guiding part such that said guiding part is located entirely in said upper section of the bore to provide said pin with a lateral freedom with respect to said insulating piece and said pin is self centered in said hole by contact between said third tapered part of said pin and the hole of said board.

2. The connector assembly according to claim 1 wherein said guiding part comprises two longitudinally spaced apart shoulders engaged with two spaced apart corresponding sized sections of said bore.

* * * * *